US010472026B2

(12) United States Patent
Lee

(10) Patent No.: US 10,472,026 B2
(45) Date of Patent: Nov. 12, 2019

(54) LATERAL FOIL SYSTEM FOR SURFBOARDS

(71) Applicant: AQUAFOIL TECHNOLOGIES, LLC, Carbondale, CO (US)

(72) Inventor: Steven M. Lee, Carbondale, CO (US)

(73) Assignee: Aquafoil Technologies, LLC, Carbondale, CO (US)

( * ) Notice: Subject to any disclaimer, the term of this patent is extended or adjusted under 35 U.S.C. 154(b) by 0 days.

(21) Appl. No.: 15/844,401

(22) Filed: Dec. 15, 2017

(65) Prior Publication Data

US 2018/0170492 A1 Jun. 21, 2018

Related U.S. Application Data

(60) Provisional application No. 62/434,687, filed on Dec. 15, 2016.

(51) Int. Cl.
*B63B 35/79* (2006.01)

(52) U.S. Cl.
CPC ..... *B63B 35/7923* (2013.01); *B63B 35/793* (2013.01)

(58) Field of Classification Search
CPC ..... B63B 35/7923; B63B 35/793
See application file for complete search history.

(56) References Cited

U.S. PATENT DOCUMENTS

2013/0298813 A1* 11/2013 Keller ..... B63B 35/7923 114/39.15
2017/0001693 A1* 1/2017 Elliott ..... B63B 35/793

* cited by examiner

*Primary Examiner* — Stephen P Avila
(74) *Attorney, Agent, or Firm* — Mintz Levin Cohn Ferris Glovsky and Popeo, P.C.

(57) ABSTRACT

A hydrofoil and hydrofoil system for a surfboard is disclosed. The surfboard has a planar hull defined by a top surface, a bottom surface, a nose, a tail, and opposing side rails extending from the nose to the tail and that define a transition from the top surface to the bottom surface. The hydrofoil system includes one or more attachment mechanisms mounted with the planar hull at or proximate to at least one of the opposing side rails of the planar hull, each of the one or more attachment mechanisms comprising an attachment site oriented substantially laterally from the planar hull. The hydrofoil system further includes a hydrofoil configured to attach to the attachment site of one of the one or more attachment mechanisms, the hydrofoil further being configured to extend substantially laterally from the planar hull at or proximate to the at least one of the opposing side rails of the planar hull.

10 Claims, 25 Drawing Sheets

Symmetric

Semi-symmetric

Flat bottom

Under combened

Plate like

VS.

NOMENCLATURE

LATERAL FOIL SYSTEM FOR SURFBOARDS

CROSS REFERENCE TO RELATED APPLICATIONS

The present application claims priority to U.S. Provisional Patent Application No. 62/434,687, filed on Dec. 15, 2016, entitled LATERAL FOIL SYSTEM FOR SURFBOARDS, the contents and disclosures of the aforementioned application is hereby incorporated by reference in its entirety herein.

BACKGROUND

The present invention relates to surfboards, and more particularly to surfboards with a lateral foil system.

Surfboards are watercraft that can be ridden on water, typically in waves. The term "surfboard" may include, without limitation, body boards, wind surfing boards, body surfing suits, stand up paddle boards, wake surfing board and other hulled craft which carry a rider, and usually utilizing the energy of water waves. Surfboards typically rely on hydrostatic lift, or buoyancy, to eventually achieve a state of planing, in which forward movement of the surfboard is supported by hydrodynamic lift (planing hull lift) of water moving along the surfboard's bottom surface.

With forward motion, surfboards generate lift that buoy both the craft and rider while being propelled along a wave face in the planing hull lift mode. Planing hull lift of surfboards is supported by bottom channels and concavities, but can also be powered by control surfaces, such as fins, that provide foil lift. FIG. 28 illustrates examples of planing hull lift versus foil lift. Conventional fins extend downwardly from the bottom surface of the surfboard, as shown in FIG. 28.

For nomenclature that is pertinent to the background of the disclosure herein, and as illustrated in FIG. 29, a "nose" is the front area of surfboard and a "tail" is the rear area of surfboard. A "deck" is the top surface of the surfboard, and a "bottom" is the under or bottom surface of the surfboard. A "length overall" (LOA) is the distance from the tip of the tail to the tip of the nose, and a "width" is the widest distance in plan view. The "center line" is the line bisecting the width. A "rail" is the area of surfboard where the deck transitions to the bottom, and a "rail apex" is the most outboard point of the rail.

FIG. 30 shows a reference coordinate system, in which an X-Axis runs along the surfboard longitudinal axis and is positive forwards with the origin at the rear most point of surfboard. A Y-Axis is transversal and positive to port with the origin on the surfboard centerline. A Z-Axis is vertical and positive upwards with the origin level with the lowest point along the centerline. With respect to a local reference system, at any transverse cross section a reference axis runs through the rail apexes from which an anhedral angle is measured (negative downward). At any location along the rails, an angle of attack is measured (positive upward) from the tangent of the curve running through the rail apexes.

Present surfboard designs rely heavily on the surfboard's rails and bottom shape to provide lift in the form of planing hull lift. However, lift generated from a foil, i.e. foil lift, is of an order of multiple times more efficient than planing surface lift. Also, various fin setups with generally vertical orientations have been developed to provide hold (and propulsion) on a wave face. However, when viewed against actual wave particle motions in the regions of a wave being surfed, the fins are far from optimal orientation relative to the surfboard itself.

SUMMARY

This document presents a new configuration of surfboard control surfaces that increase lift, reduce drag and enhance performance characteristics of a surfboard by transferring substantial lifting and performance assignment from the body of the board to a generally laterally-oriented hydrofoil system.

A hydrofoil and hydrofoil system for a surfboard is disclosed. The surfboard has a planar hull defined by a top surface, a bottom surface, a nose, a tail, and opposing side rails extending from the nose to the tail and that define a transition from the top surface to the bottom surface. The hydrofoil system includes one or more attachment mechanisms mounted with the planar hull at or proximate to at least one of the opposing side rails of the planar hull, each of the one or more attachment mechanisms comprising an attachment site oriented substantially laterally from the planar hull. The hydrofoil system further includes a hydrofoil configured to attach to the attachment site of one of the one or more attachment mechanisms, the hydrofoil further being configured to extend substantially laterally from the planar hull at or proximate to the at least one of the opposing side rails of the planar hull.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a new configuration of surfboard control surfaces that increase lift, reduce drag and enhance performance characteristics of a surfboard by transferring substantial lifting and performance assignment from the body of the board to a generally laterally-oriented hydrofoil system.

Figure 1:
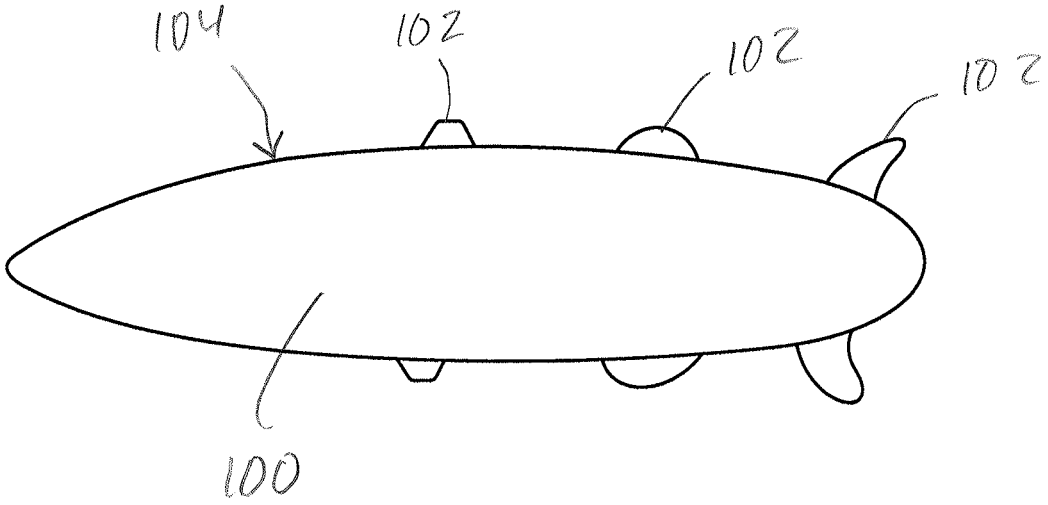
FIG. 1 is a plan view of a surfboard with lateral hydrofoils.
Figure 2:
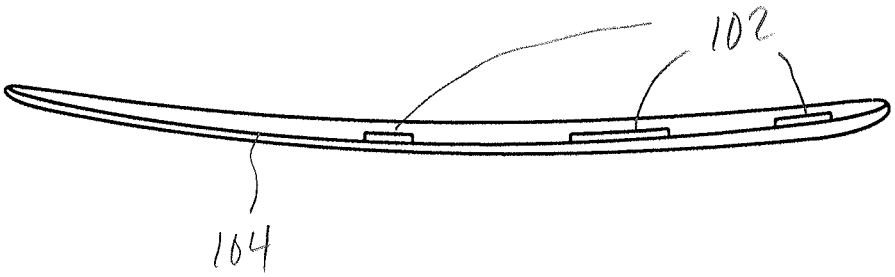
FIG. 2 is a side view of a surfboard with lateral hydrofoils.

In accordance with exemplary implementations, and as illustrated in FIGS. 1 and 2, one or more lateral hydrofoils 102, as part of a lateral hydrofoil system, can be attached to, or extend from, one or more attachments sites at or proximate to a rail 104 of a surfboard 100. In preferred implementations, each lateral hydrofoil 102 and lateral hydrofoil system is located between a midpoint of the surfboard 100 and the tail of the surfboard 100. Depending on the shape and contours of the surfboard 100, and on which part of the rail of the surfboard 100 is pushed into the moving face of a wave, the lateral hydrofoil(s) 102 can be positioned and/or adjusted to add additional foil lift. Various factors can influence a position of a hydrofoil 102 on the surfboard 100, including weight and/or style and/or experience of a rider, a size and/or shape and/or speed of a wave, etc.

The lateral hydrofoil system can be used alone, or in combination with conventional bottom-extending hydrofoils or fins. Further, a surfboard can include one or more bottom features, such as channels, concavities, ridges, or the like, that influence flow in the region of foils to optimize foil characteristics of foils, to include bottom fins that are designed for the same purpose, i.e. to direct water optimally to lateral hydrofoil(s).

Figure 3:
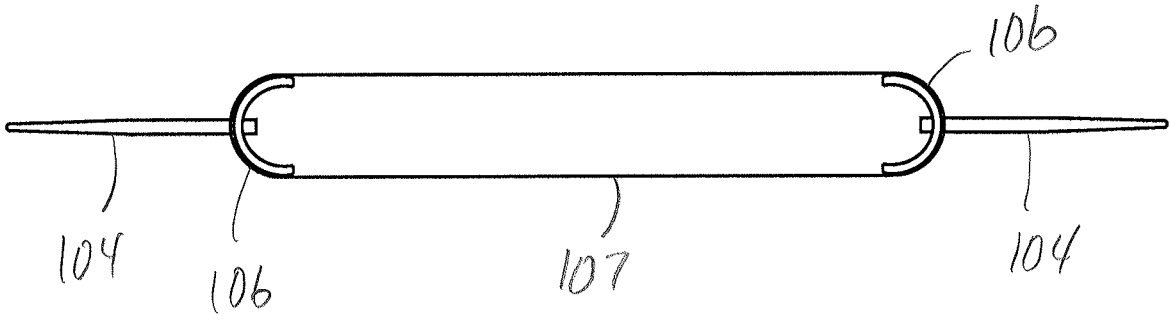
FIG. 3 is a front view of a surfboard with lateral hydrofoils at opposing rails of the surfboard.
Figure 4:
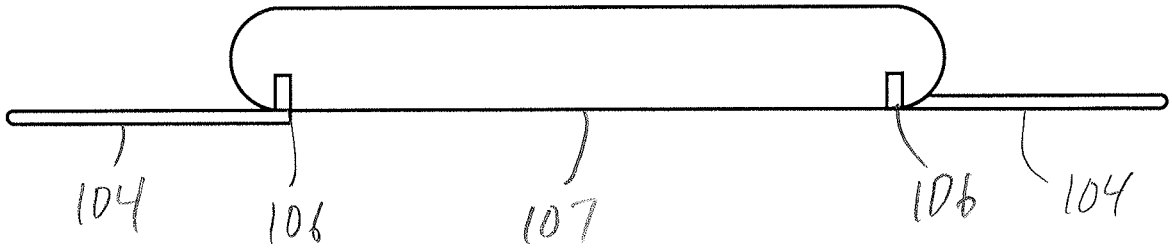
FIG. 4 is a front view of a surfboard with lateral hydrofoils at a bottom of the surfboard proximate the rails of the surfboard.

In some preferred implementations, the lateral hydrofoils 102 are attached via an attachment mechanism 106 at the rear third section of a surfboard 100, or at least at the rear half of the surfboard 100. However every point along the rail of the surfboard 100 are possible attachment sites, as illustrated in FIGS. 1 and 2. While hydrofoil attachment is preferably at the rail 104, as shown in FIG. 3, a primary attachment site can be at or from a bottom surface 107 of the surfboard 100, as shown in FIG. 4.

At least one hydrofoil 102 is attached to at least one side of the surfboard 100, but preferably two or more lateral hydrofoils 102 are attached to the surfboard 100. Further, in some instance, a surfboard 100 can include a lateral hydrofoil 102 on only one side, depending on factors such as a direction of wave or a preferred stance of a rider. In other instances, two or more lateral hydrofoils 102 are attached to, or extend from, both sides of the surfboard 100. More than one hydrofoil 102 can be attached to, or extend from, one or more sides of surfboard 100 at or proximate to the rail(s) 104 of the surfboard 100.

The lateral hydrofoil system can include one or more attachment structures or mechanisms 106 formed at a site at or proximate the rail 104 of the surfboard 100, and can include at least one site per side rail 104. However, in some implementations, the hydrofoil system can include at least two or more sites for such attachment mechanisms 106. In yet other implementations, the system can include two, four, six, eight or even ten or more sites. Further, each attachment mechanism 106 can include a site that is adjustable, i.e. a channel, a moving or slidable connector, or other mechanism that allows adjustability and desired positioning, as well as a desired angle and cant, of the hydrofoil 102 extending substantially laterally from the surfboard 100.

Attachment structures for the lateral hydrofoils 102 preferably have the capacity to withstand a minimum of 20 ft.lb of torque normal to plane of a greatest lateral hydrofoil surface area, and can preferably withstand 50 to 120 ft.lb of torque, and in some implementations can withstand 120 to 200 ft.lb of torque. In some implementations, the hydrofoil(s) 102 are formed of a material or of a construction so as to be able to flex or bend slightly under various or variable torques or pressure. For instance, the hydrofoils 102 can be formed of fiberglass, carbon fiber, foam, a resin such as epoxy, molded plastic, metal (such as aluminum or steel), etc., or any combination thereof.

Figure 5:
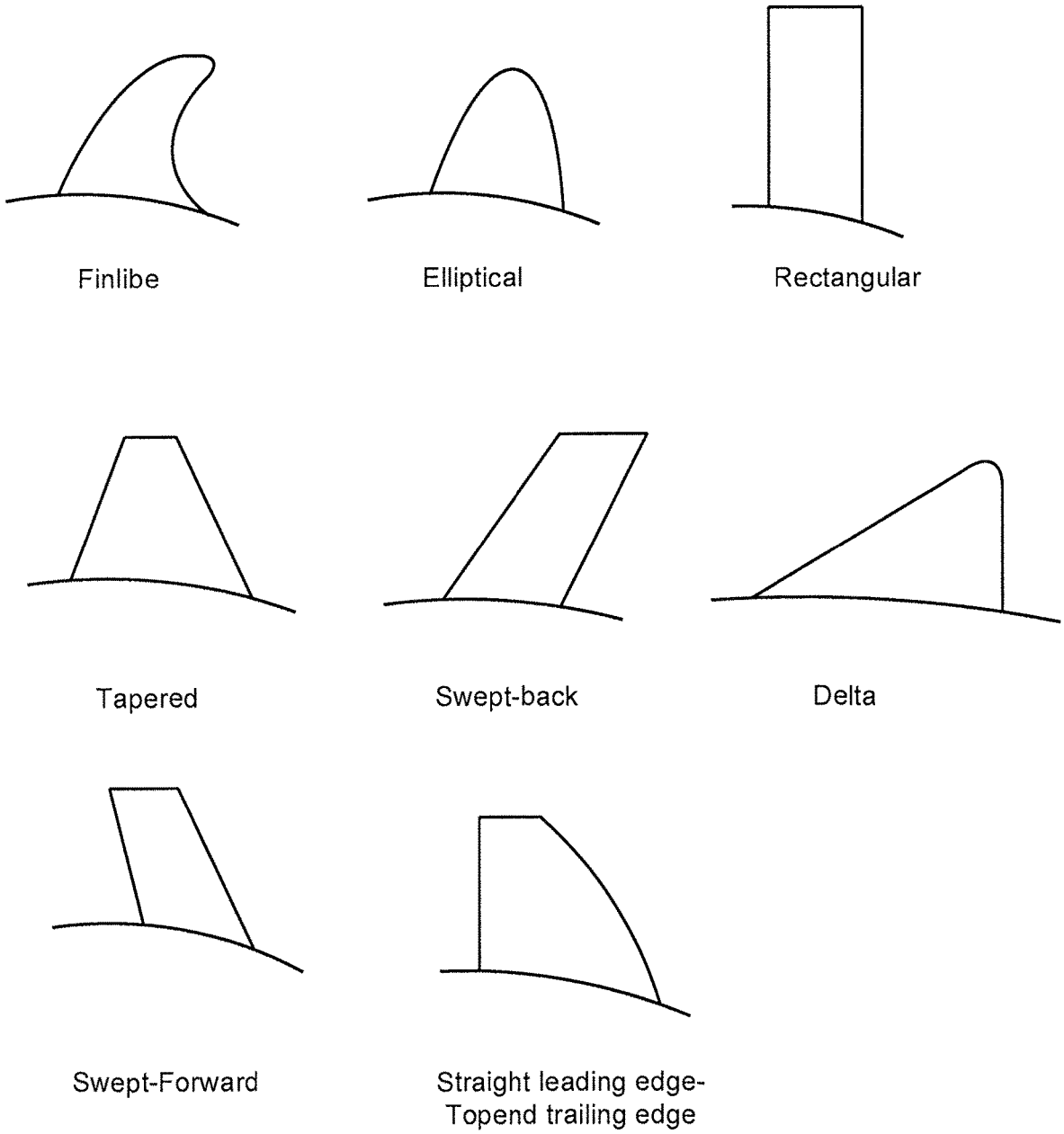
FIG. 5 shows various hydrofoil shapes.

A geometry of the hydrofoils 102, including hydrofoil cross section, may vary from the base to tip of each hydrofoil 102. For instance, a hydrofoil 102 can have one or a combination of the following plan shapes, as shown in FIG. 5 as extending from a side of a surfboard 100 at or proximate to a rail 104 or bottom 107 of the surfboard 100: fin like, elliptical, rectangular, tapered, swept-back, delta, swept-forward, straight leading edge—tapered trailing edge. A hydrofoil's 102 plan area may be within a range from 1 to 150 square inches, and preferably 2 to 40 square inches, and in some implementations within the range of 3 to 20 square inches. In one exemplary implementation, for a hydrofoil 102 mounted proximate the rail of a surfboard toward the tail, the hydrofoil has a surface area of 5 to 6 square inches.

Figure 6:
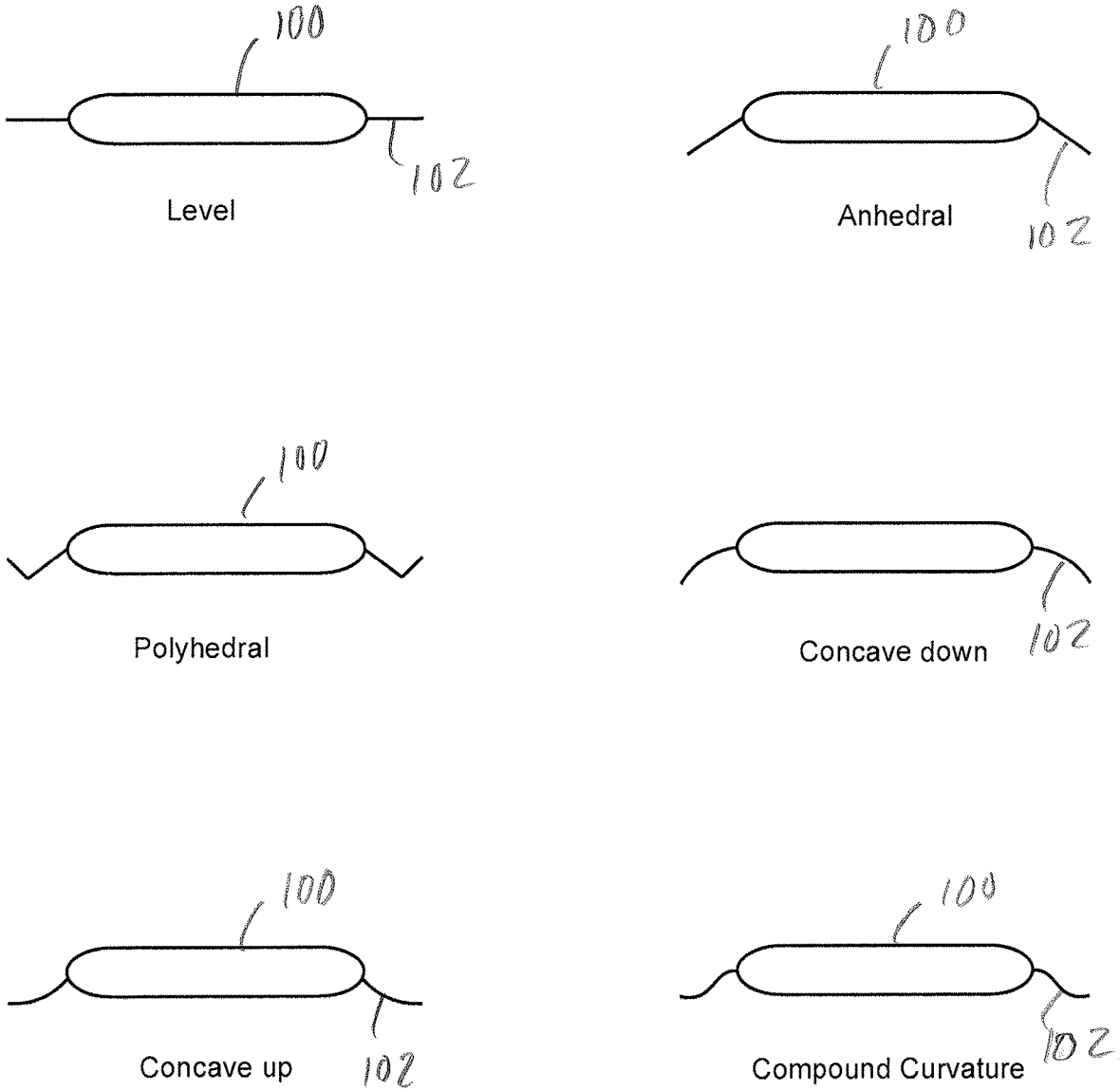
FIG. 6 shows various hydrofoil geometrical orientations.

FIG. 6 illustrates a number of geometries of a lateral hydrofoil 102 or lateral hydrofoil system, as viewed from the front of a surfboard 100. The geometries, exclusive of angle of attack, can include, without limitation: level, anhedral (sloped down), polyhedral, concave down, concave up, compound curvature. An angle of any of the geometries other than level can be adjustable. The hydrofoil 102 may incline from the axis through rail apexes within a range of +45 to −90 degrees, preferably −10 to −60 degrees and in some embodiments within the range of from about −30 to −50 degrees. The arch of concavity, either upward or downward, can also be adjustable. For a hydrofoil 102 that has adjustable anhedral angle, the range of adjustment may be at least about 15 degrees, in some embodiments at least about 30 degrees or 45 degrees but generally less than 90 degrees.

Figure 7:
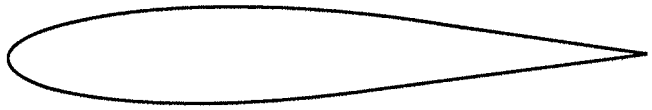
FIG. 7 shows various cross-sections of hydrofoils.
Figure 7:
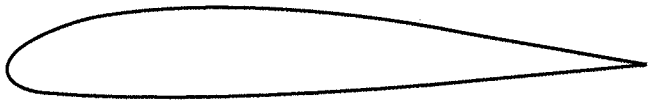
Figure 7:
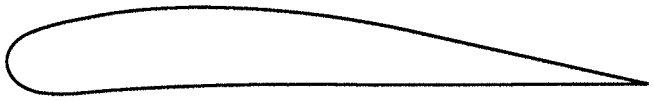
Figure 7:
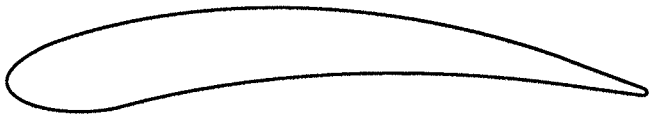
Figure 7:
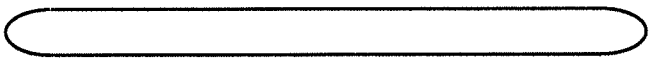

FIG. 7 illustrates various cross sections of a hydrofoil 102. The cross sections can include, without limitation: symmetrical, semi-symmetrical, flat bottom, under-cambered, plate like. In some implementations, the cross section of a hydrofoil 102 can change from one cross section to one or more other cross sections, from a base of the hydrofoil 102 to a distal end of the hydrofoil 102.

Figure 8:
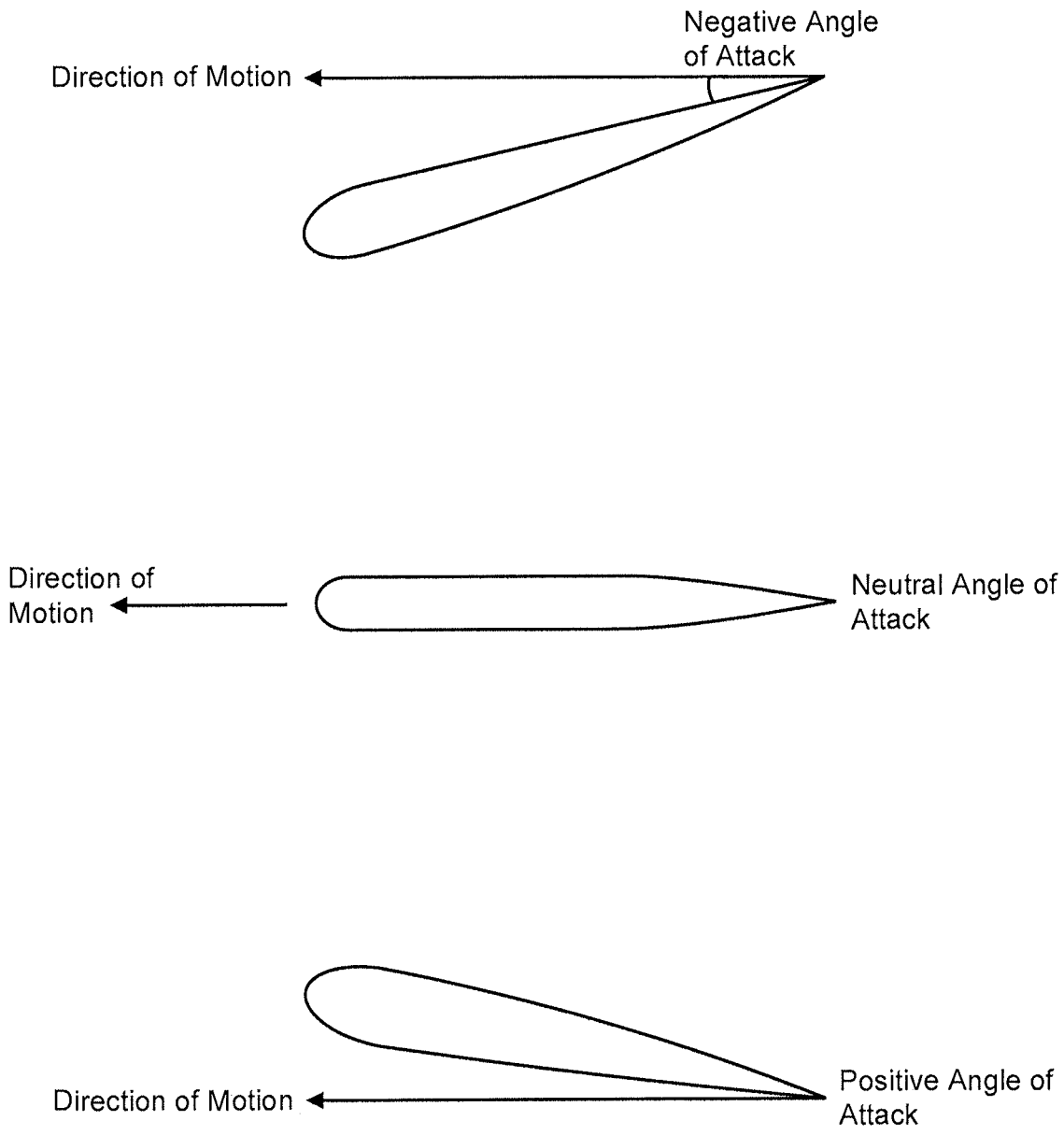
FIG. 8 illustrates various angles of attack for a hydrofoil.

FIG. 8 illustrates various angles of attack of a hydrofoil 102 relative to a direction of motion. Hydrofoils 102 may have an angle of attack that is not parallel with a tangent to the curve running through rail apexes. A positive angle of attack is defined by the leading edge of hydrofoil 102 being higher than trailing edge. Correspondingly, a negative angle of attack is defined by the leading edge of the hydrofoil 102 being lower than the trailing edge. The angle of attack of a hydrofoil 102 may be within a range from +45 degrees to −45 degrees, preferably −15 to +15 degrees and in some implementations −5 to +5 degrees. For a hydrofoil that has an adjustable angle of attack, the range of adjustment may be between +45 to −45 degrees, preferably −15 to +15 degrees and in some implementations −5 to +5 degrees.

The lateral hydrofoil system can include one or more attachment mechanisms. In some implementations, a lateral hydrofoil 102 can be formed along with a fiberglass coating of the surfboard 100, which is otherwise known as "glassed-in fins." In these implementations, the lateral hydrofoil 102 is fixed, and its position, angle of attack, or cross section cannot be adjusted or replaced.

In alternative preferred implementations, attachment of the hydrofoil 102 to a surfboard 100 is modular, using an attachment mechanism that allows hydrofoils 100 to be attached at one or more different locations along the rail 104 of the surfboard 100 to change performance characteristics of the surfboard 100. Such modular hydrofoils 102 allow interchangeability of hydrofoils 102 of different geometries to obtain different performance characteristics for the surfboard 100. Modular hydrofoils may have an adjustable angle of attack, and/or adjustable anhedral angle, to augment performance altering possibilities.

The attachment mechanism of the lateral hydrofoil system can include one or more of a number of attachment mechanisms, including, but not limited to, bumps, ridges, groves, threads, protrusions, channels, screws, bolts, clips, latches, flanges, etc. that facilitate locking hydrofoils 102 into a fixed or variable position on the surfboard 100.

Figure 9A:
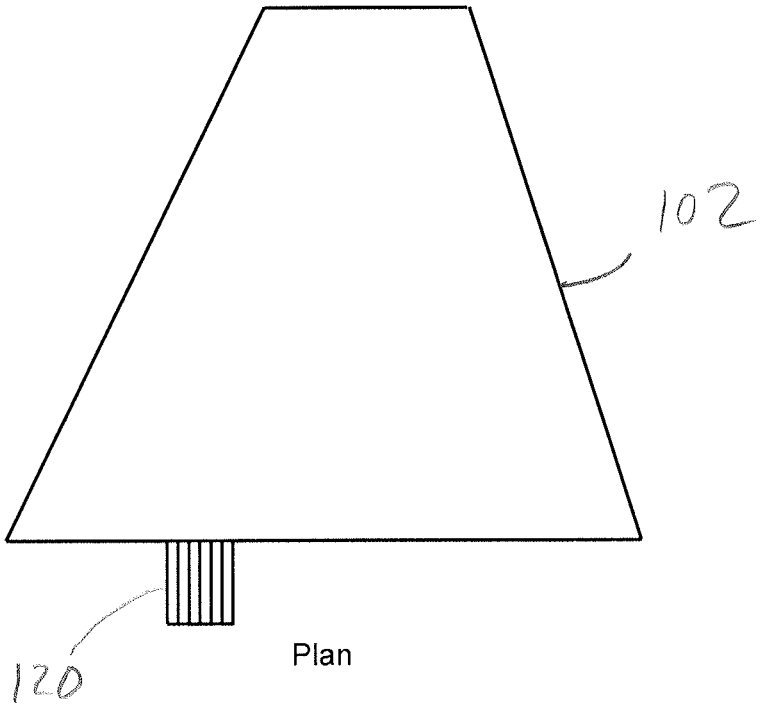
FIGS. 9-25 illustrate various connection mechanisms and/or locking mechanisms for connecting a laterally-extending hydrofoil to a surfboard.
Figure 9B:
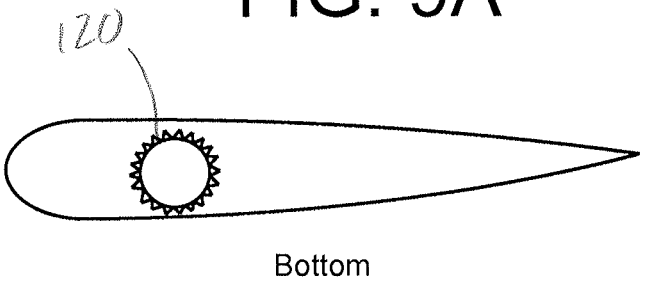
Figure 9C:
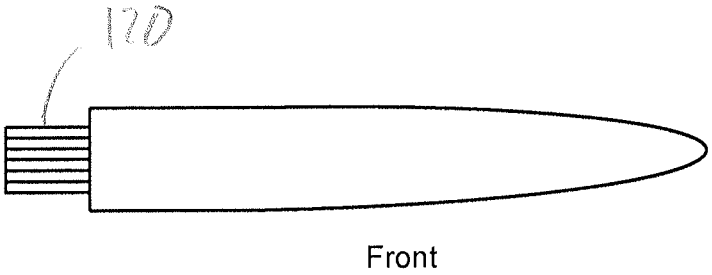
Figure 10:
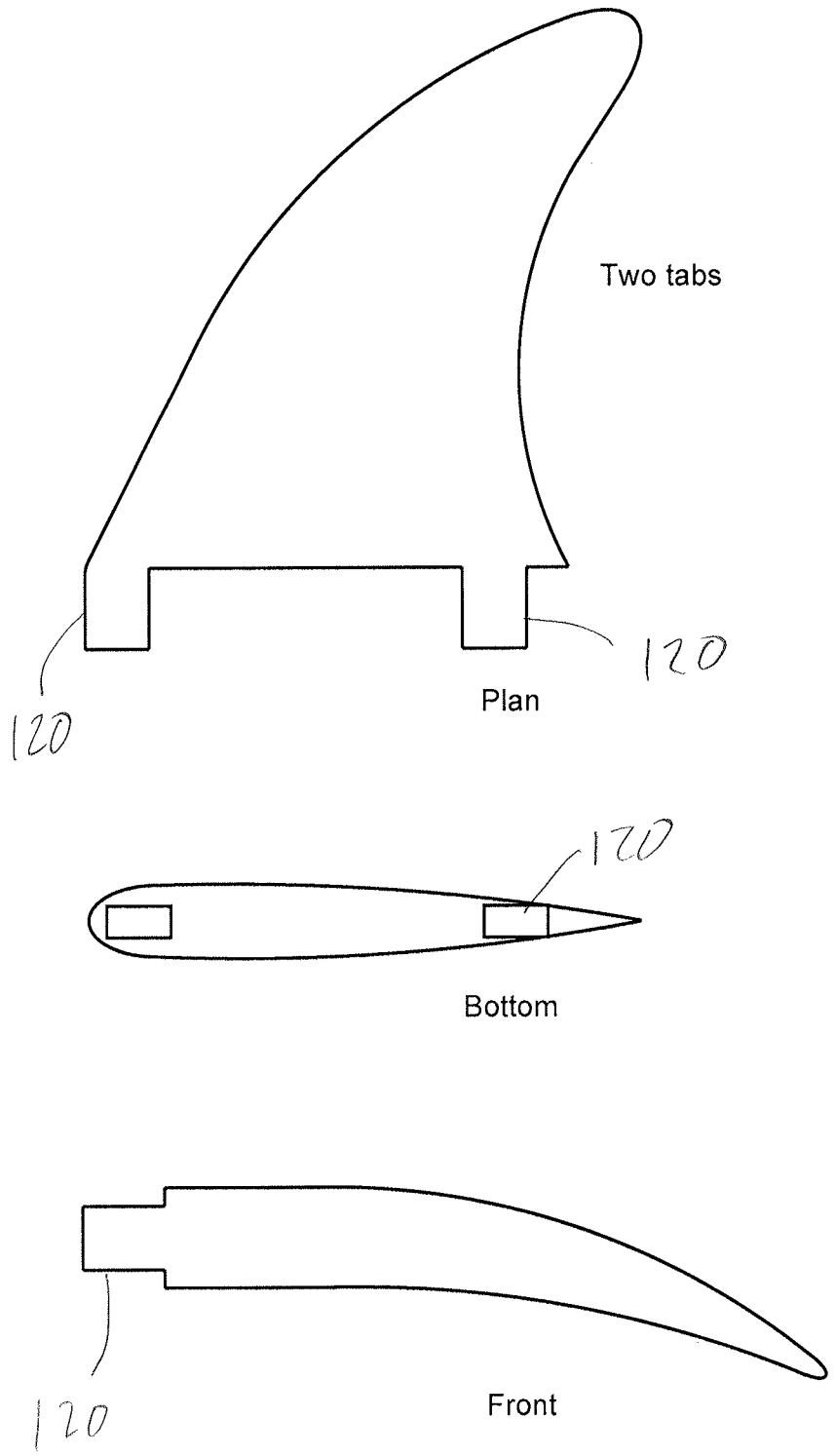

For example, FIGS. 9A-C illustrate a single cylindrical male protrusion 120 with circumferential ridges for adjustable rotation for variable angle of attack. Accordingly, the male protrusion 120 can mate with a corresponding female receptacle (not shown) that includes corresponding reception ridges for engaging with the circumferential ridges of the male protrusion at a desired rotational position. In some implementations, the male protrusion 120 need not be cylindrical, and can have any cross-sectional shape, such as oval, egg-shaped, squared, rectangular, or curvilinear, or the like. In still other implementations, a hydrofoil 102 can include two or more male protrusions, as shown in FIG. 10.

Figure 11:
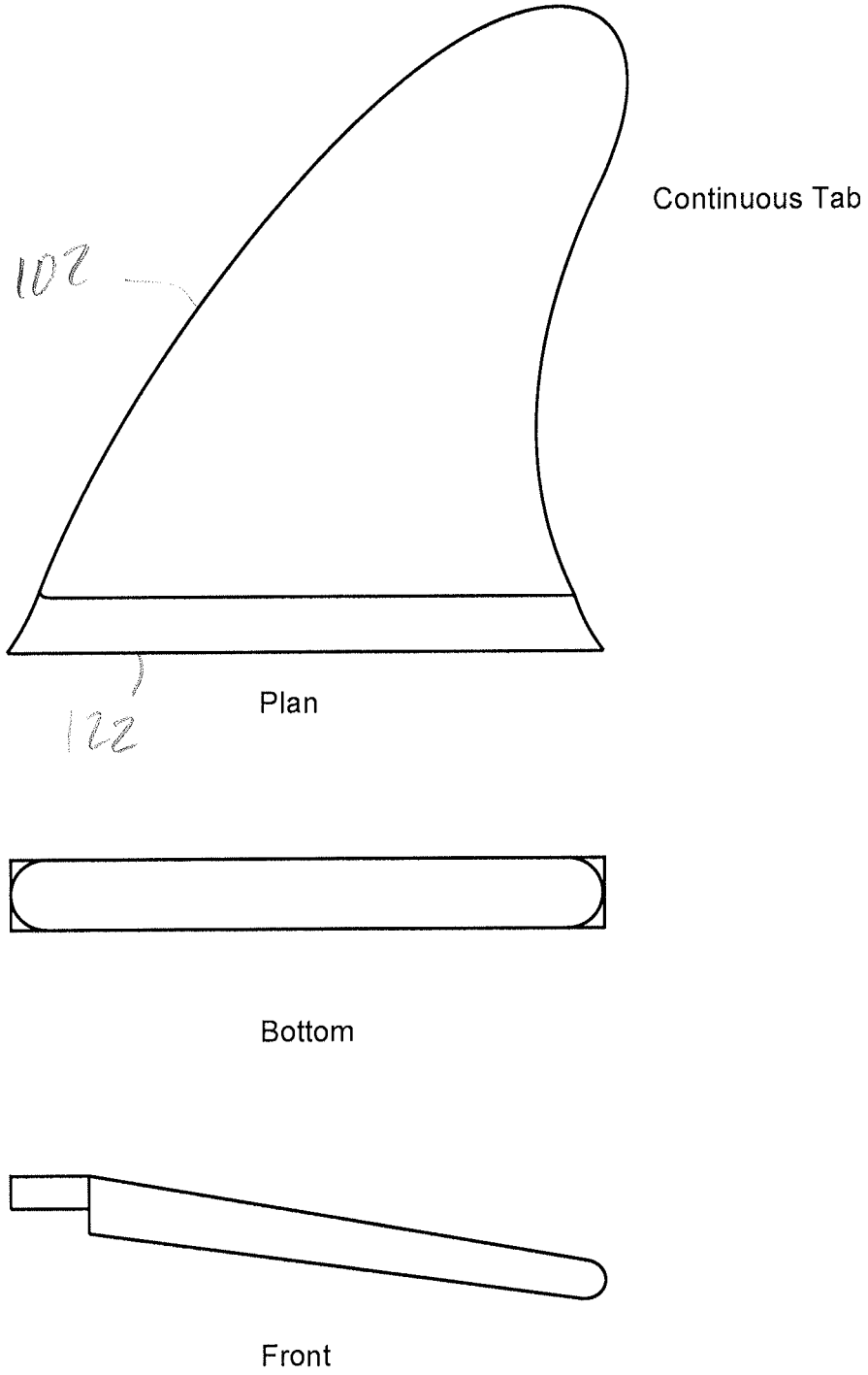
Figure 12:
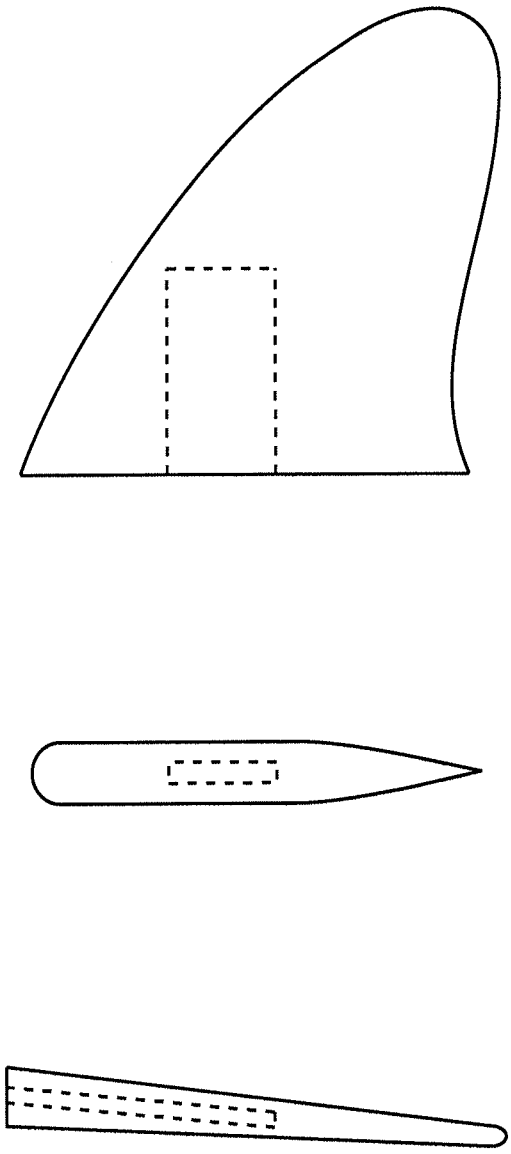

In some implementations, a single male protrusion (or female corresponding mechanism) can be formed as a continuous tab 122, that extends along at least part or all (or more) of a base of the hydrofoil 102, as shown in FIG. 11. In yet still other implementations, a hydrofoil system can be reversed, where the hydrofoil 102 includes one or more channels, receptacles, holes, etc. for receiving a corresponding one or more protrusions that extend substantially laterally from the surfboard 100, such as from a "fin box" or other mechanism applied to the surfboard 100, as shown in FIG. 12.

Figure 13A:
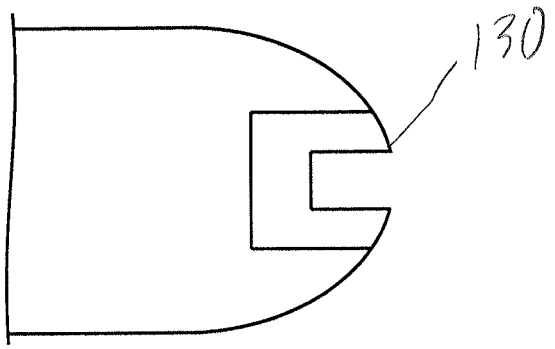
Figure 13B:
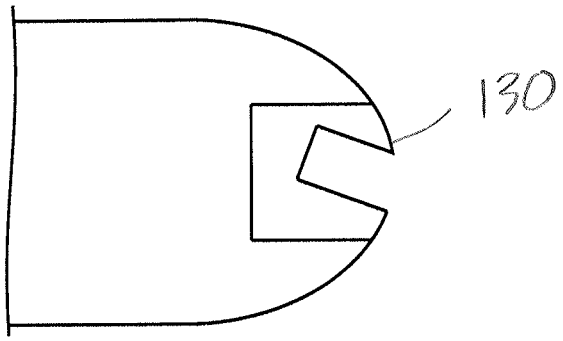
Figure 13C:
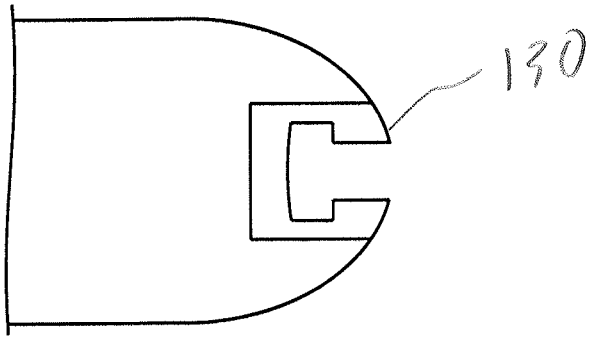

For a continuous channel that receives a hydrofoil male protrusion(s), various cross sections can be used, as shown in FIGS. 13A-C. The continuous channel 130 can be located along portions of the length of the rail where one or more hydrofoils 102 are to be attached. The channels 130 may have internal forms including bumps, ridges, grooves, threads, etc. that facilitate locking a hydrofoil 102 into a desired position and/or angle of attack. Areas of the channels 130 not covered or obscured by a hydrofoil(s) 102 may be enclosed with one or more filler strips. In some implementations, the channels 130 are integral with the construction of the surfboard, and as such can lend themselves to the surfboard shaping process. Channels 130 may have level orientation or sloped up or down in relation to level surfboard, as shown in FIGS. 13A-C.

Figure 14A:
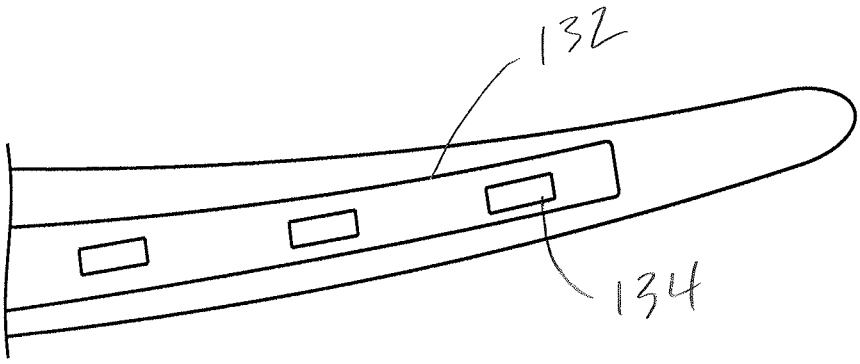
Figure 14B:
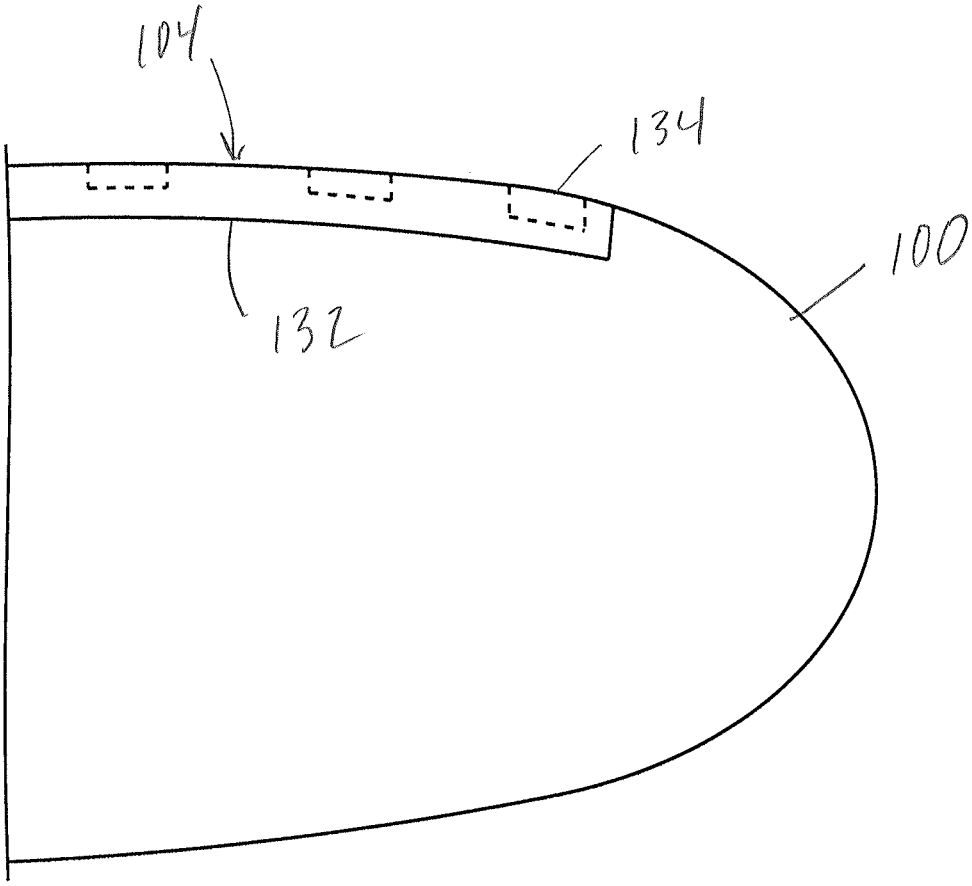
Figure 15A:
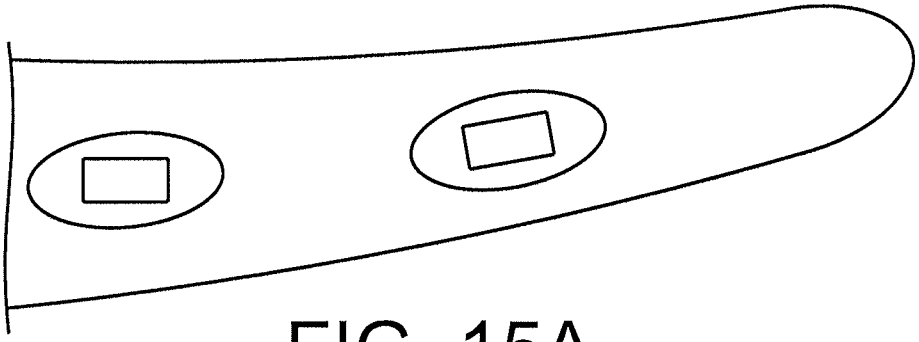
Figure 15B:
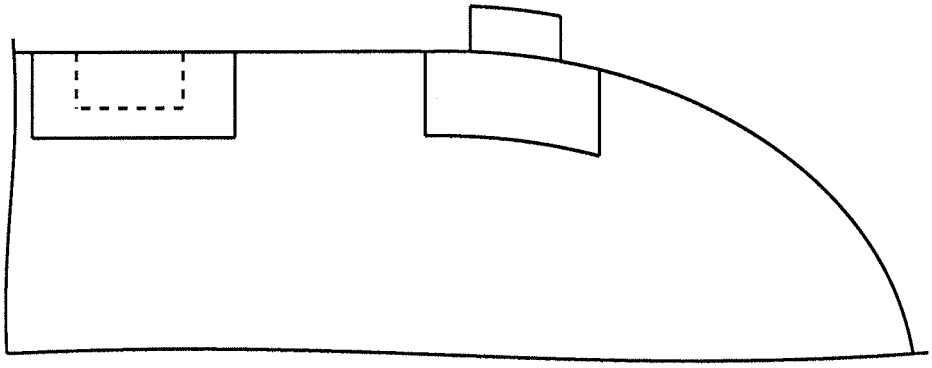
Figure 15C:
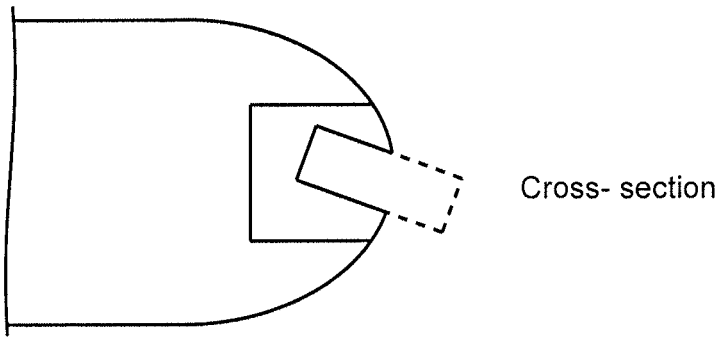

In alternative implementations, an attachment mechanism on the surfboard can include a strip 132 with attachment sites 134 embedded in the surfboard 100, preferably at or proximate to the rail 104 of the surfboard 100 or bottom of the surfboard 100. The strip 132 attachment sites may have internal forms, including bumps, ridges, groves, threads, etc. that facilitate locking hydrofoils into position. The attachment sites 134 can also include male protrusions, as well as female receptacles, or any combination thereof, as shown in FIGS. 15A-C. Attachment sites 134 may have a level orientation, or can be sloped up or down in relation to level surfboard 100, as shown in FIG. 14A.

Individual attachment sites embedded in surfboard rail at desired locations. Individual attachment sites may have internal forms including bumps, ridges, groves, threads, etc. that facilitate locking hydrofoils in to position. Male and female possible. Attachment sites may have level orientation or sloped up or down in relation to level surfboard (FIG. 15).

Figure 16:
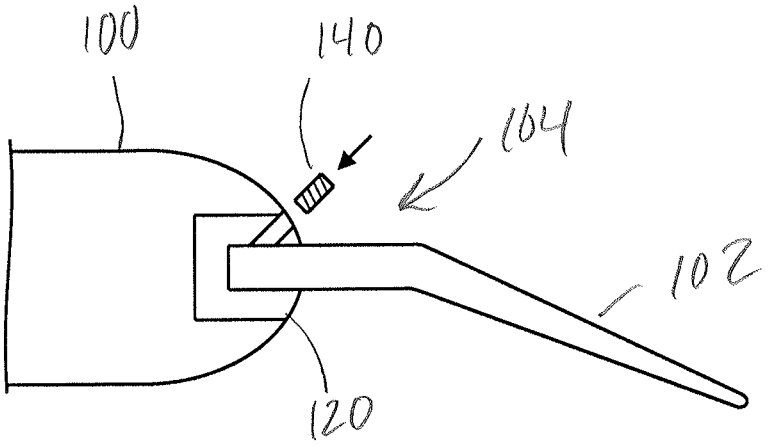
Figure 17:
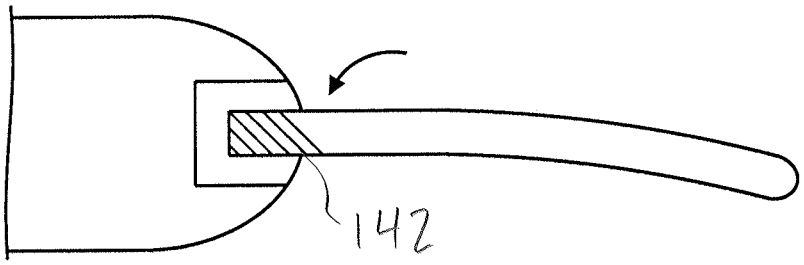
Figure 18:
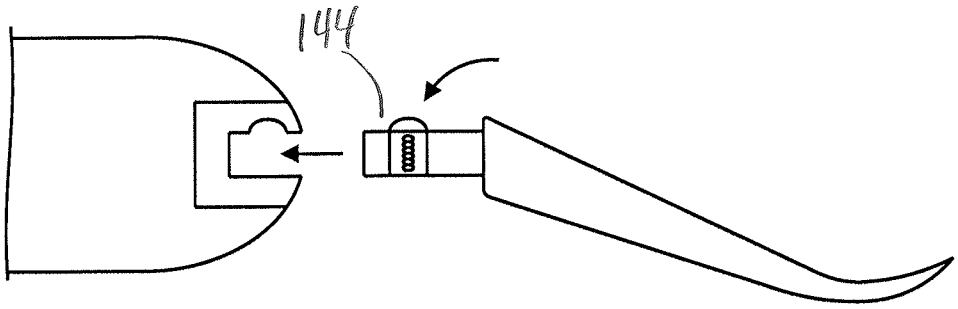
Figure 19A:
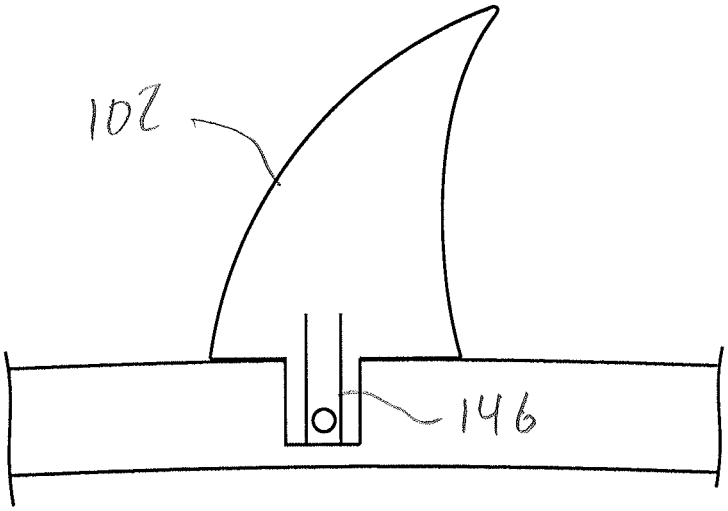
Figure 19B:
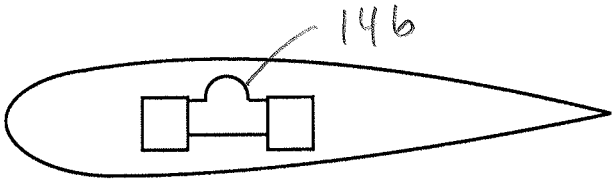
Figure 19C:
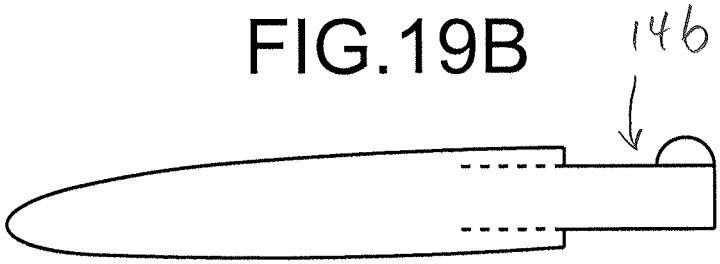
Figure 20:
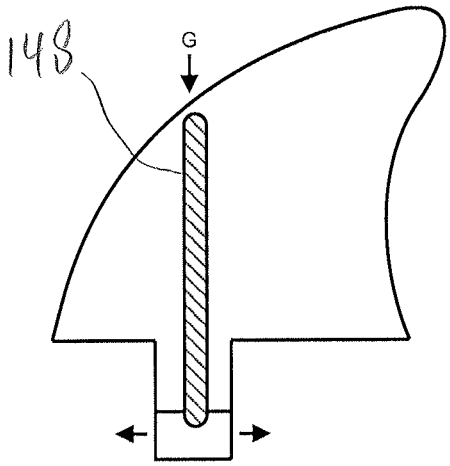
Figure 21A:
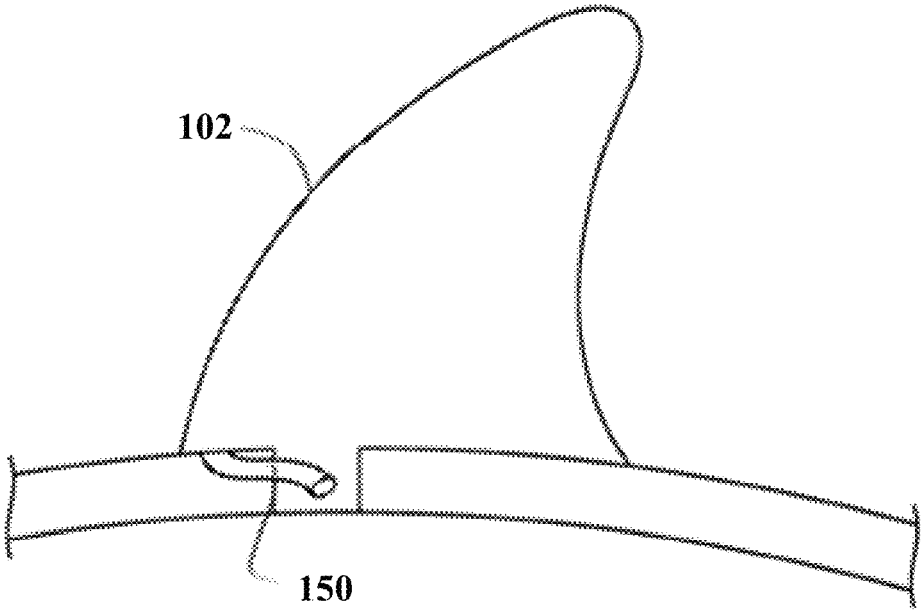
Figure 21B:
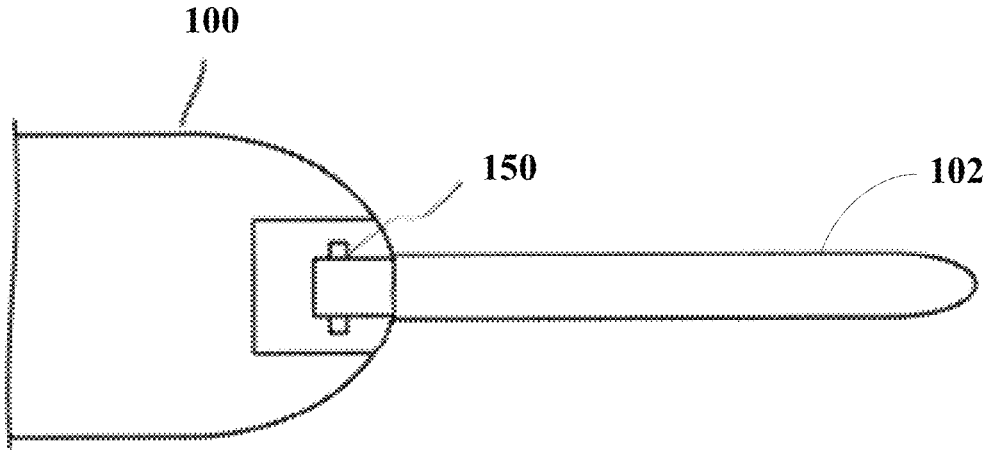
Figure 22:
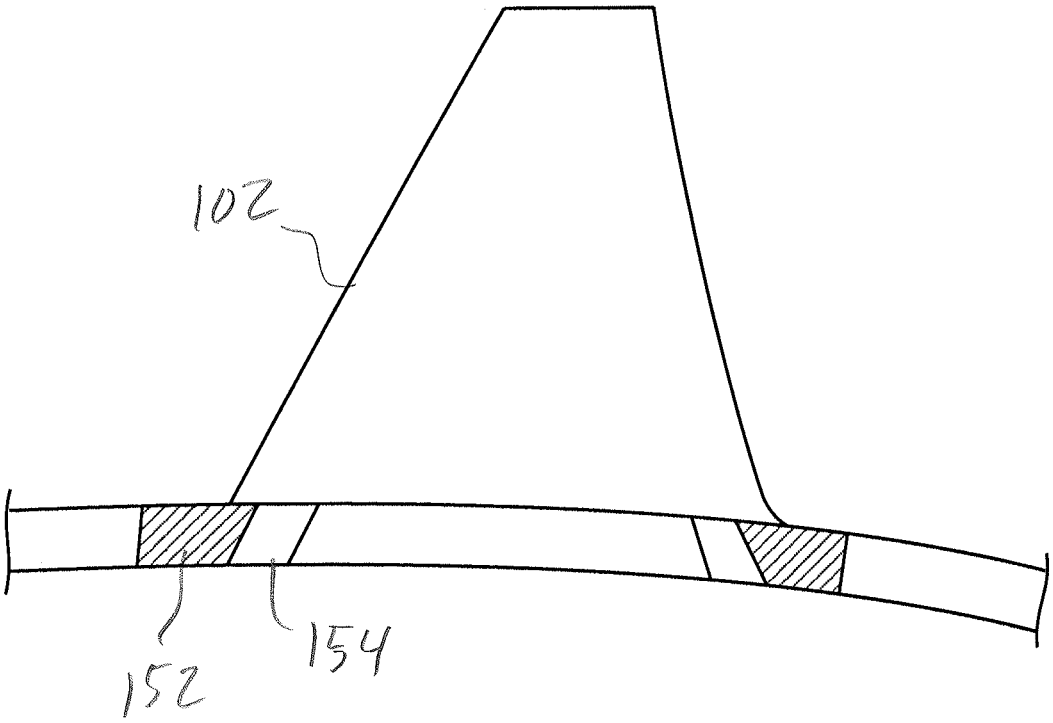

The attachment mechanism 120 can further include a locking mechanism, to lock the lateral hydrofoil 102 to the attachment site of an attachment mechanism 120 at or near a rail 104 of a surfboard 100. The locking mechanism can include, without limitation, an Allen key set screw 140, as shown in FIG. 16, a threaded assembly 142, as shown in FIG. 17, and/or a ball catch 144 as shown in FIG. 18. The locking mechanism can further include, a flex tab 146, as shown in FIGS. 19A-C, and/or an extension assembly 148 as shown in FIG. 20, and/or a peg and slot assembly 150 as shown in FIGS. 21A-B.

The locking mechanism can further include elastomeric stops 152 that abut and engage male protrusions 154 of the hydrofoil 102. The elastomeric stops 152 can include one or more springs, or be made of an elastomer such as rubber, plastic, or the like.

Figure 23A:
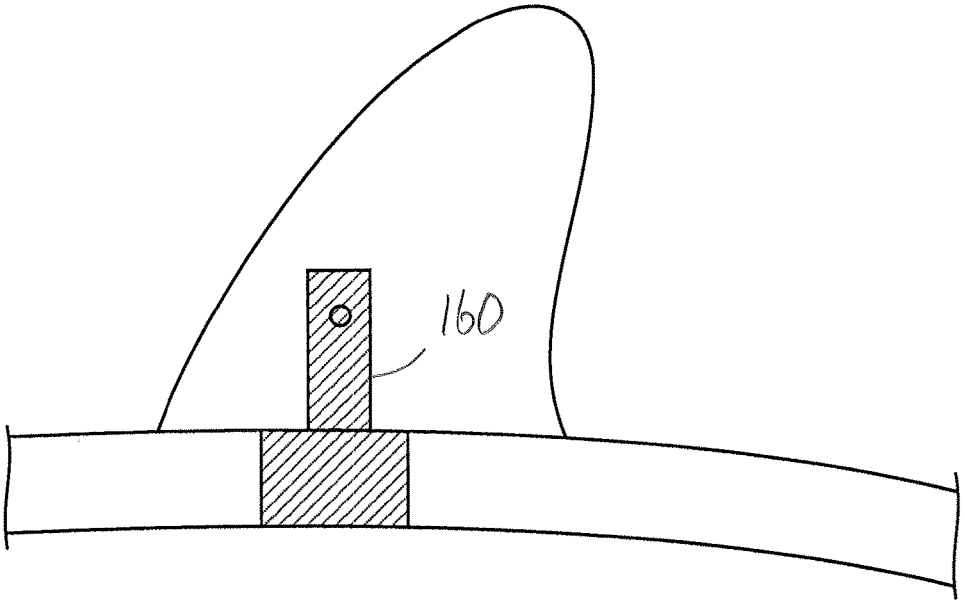
Figure 23B:
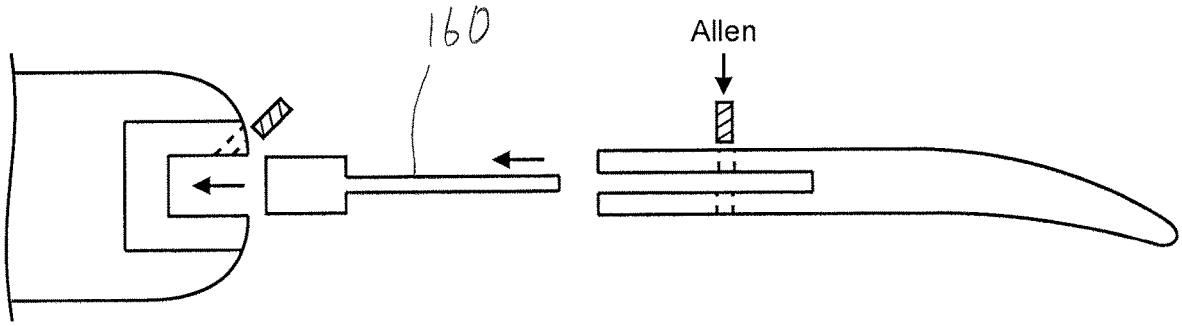
Figure 24A:
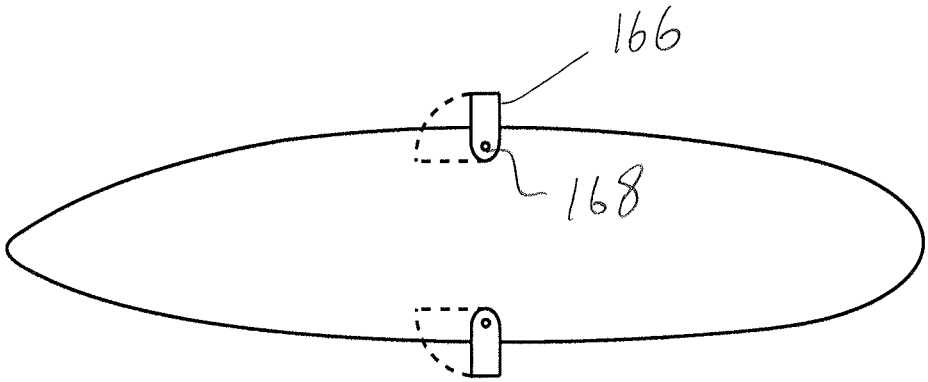
Figure 24B:
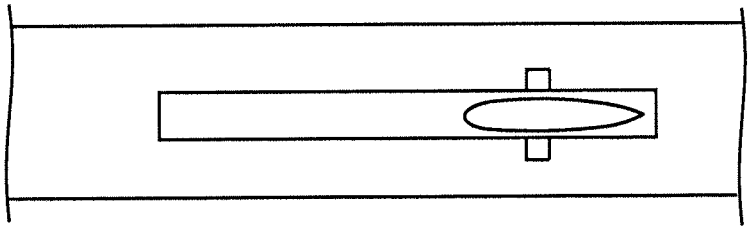
Figure 25:
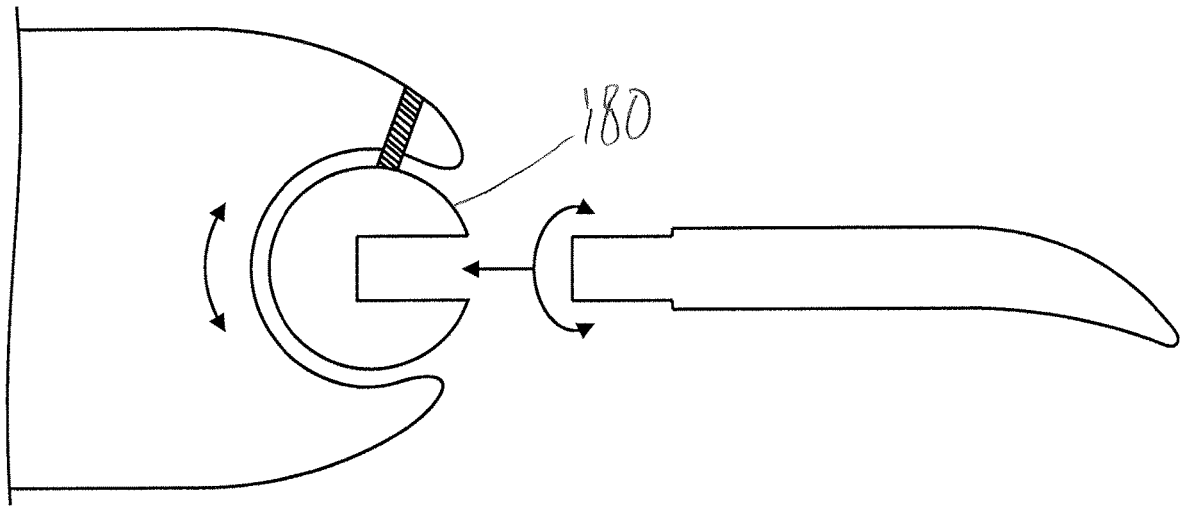

In some implementations, as shown in FIGS. 23A and B, an attachment mechanism can utilize an intermediary connecting member such as a rail-mountable male adapter 160, which can be locked into the attachment site of the attachment mechanism on the board, and further locked to the hydrofoil. The locking can be done by an Allen screw or bolt or the like. In yet other implementations, a lateral hydrofoil 102 can extended from and retracted into the surfboard 100, such as by a rotating for "flip out" mechanism, as shown in FIGS. 24A and B. In still yet other implementations, a connection mechanism can include a rotatable "rail car" connector 180, into which a male protrusion of a hydrofoil, for example, can be inserted into a receptacle formed in the connector 180. A user can adjust an angle or orientation of the rail car connector 180 for desired angle, such as a desired anhedral angle. In other implementations, the rail car connector can include a protrusion to mate with a corresponding receptacle in the hydrofoil.

Figure 26:
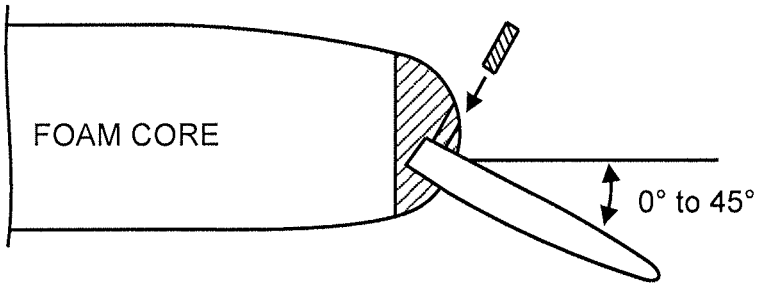
FIG. 26 illustrates a prototypical implementation of a hydrofoil installation, in accordance with the disclosure herein.
Figure 26:
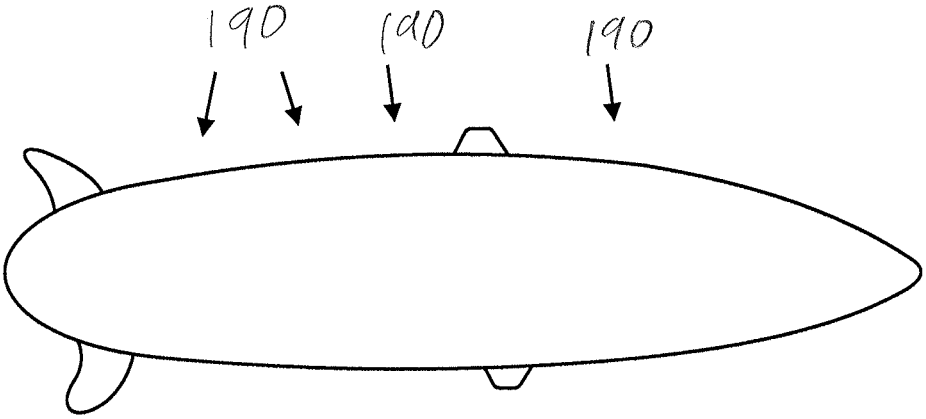
Figure 27A:
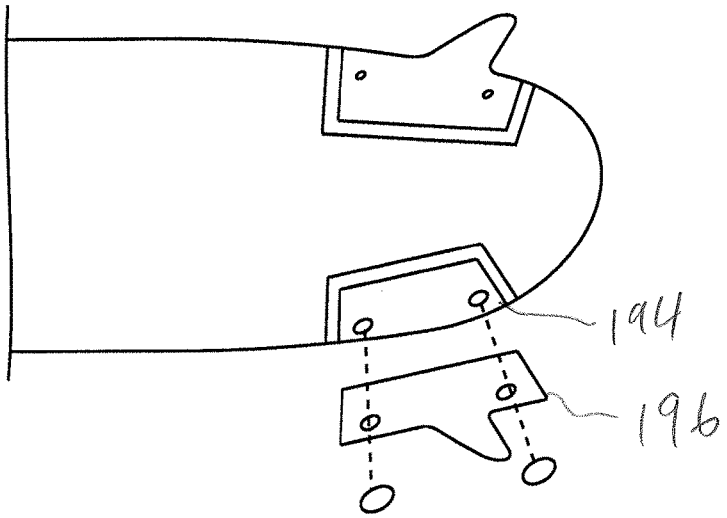
FIG. 27A-FIG. 27C illustrates an alternative attachment mechanism.
Figure 27B:
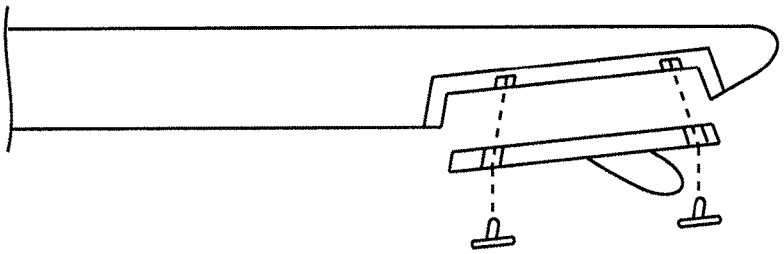
Figure 27C:
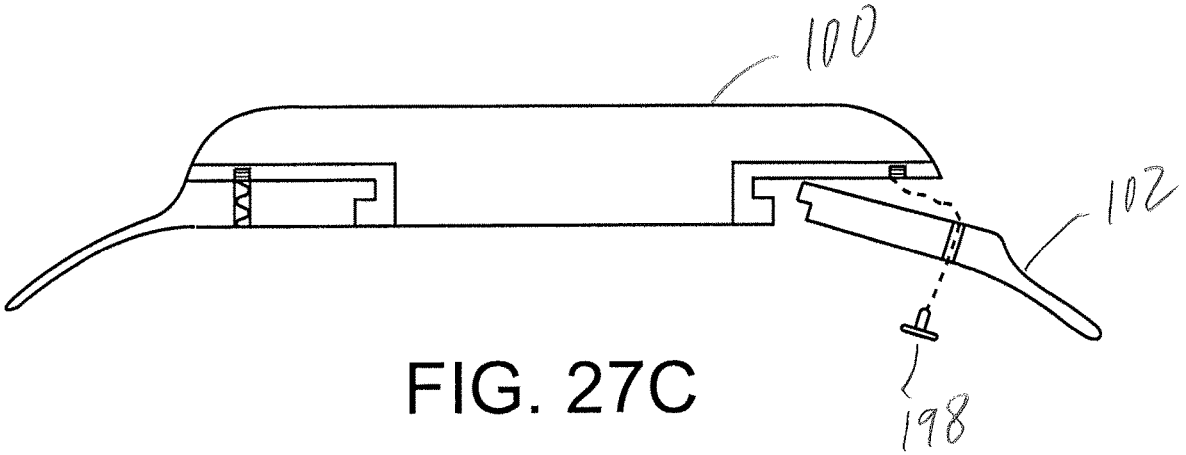
Figure 28:
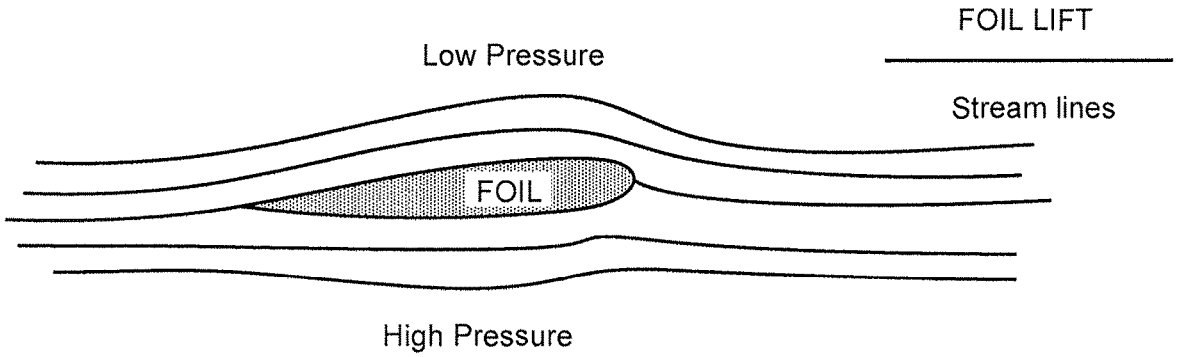
(PRIOR ART) FIG. 28
FIG. 28 illustrates foil lift versus planing lift.
Figure 28:
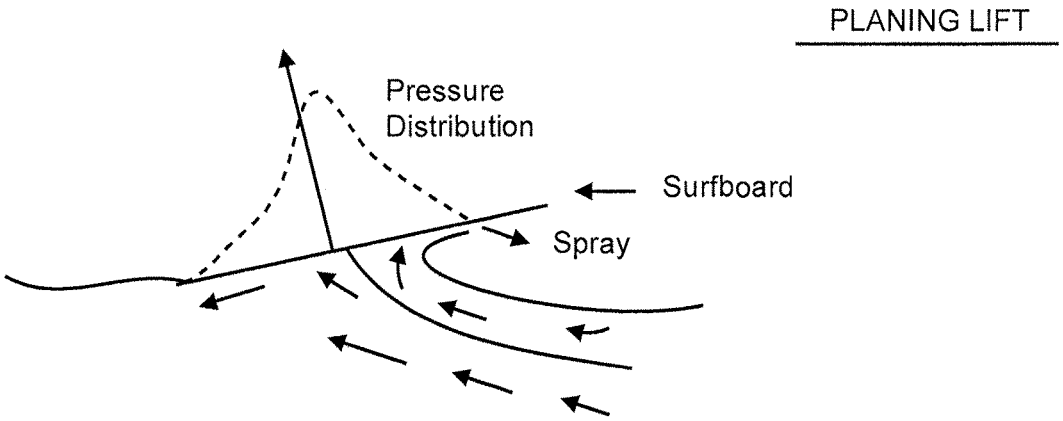
(PRIOR ART) FIG. 28
Figure 29:
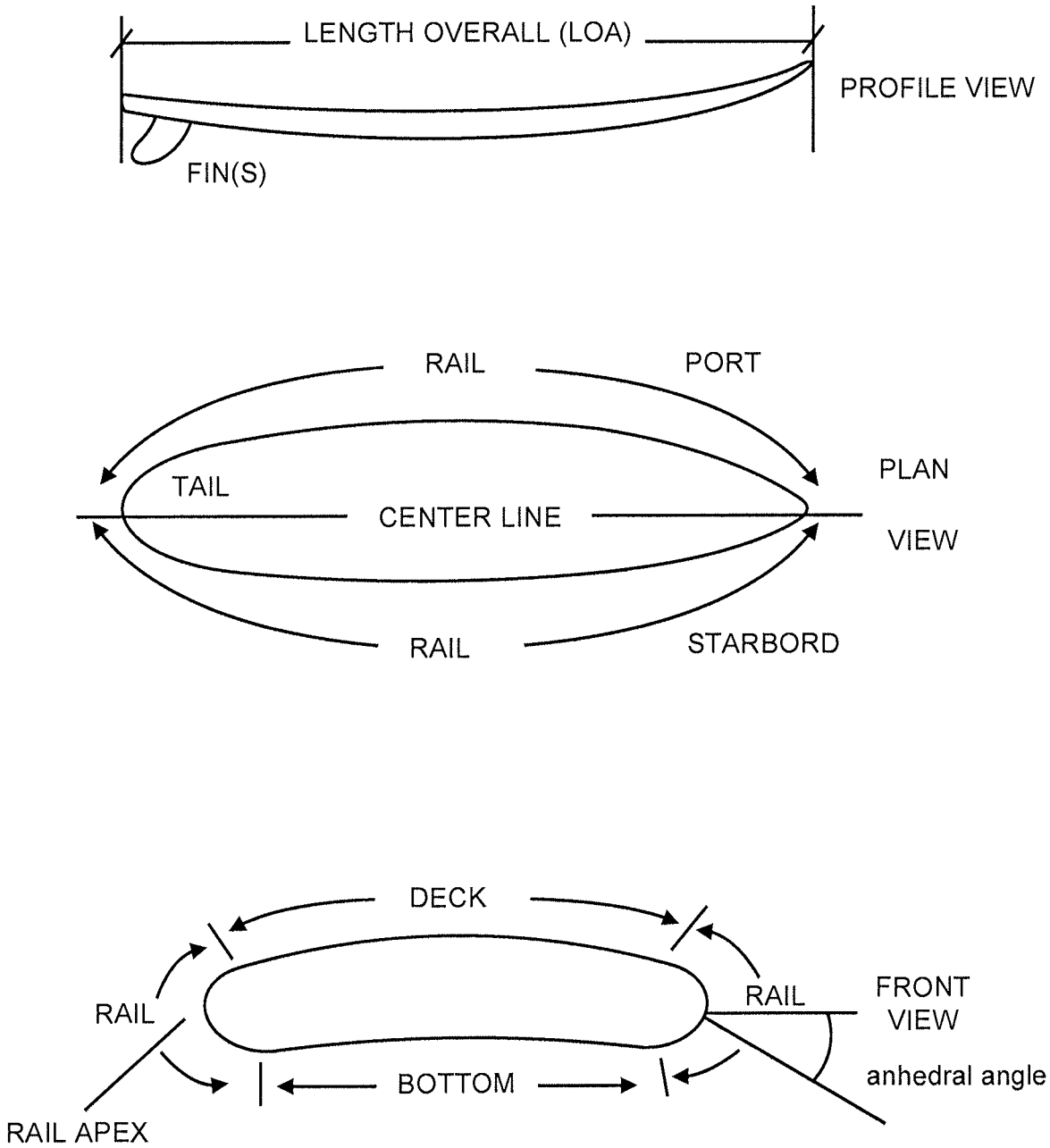
FIG. 29 illustrates certain nomenclature associated with the present disclosure.
Figure 30:
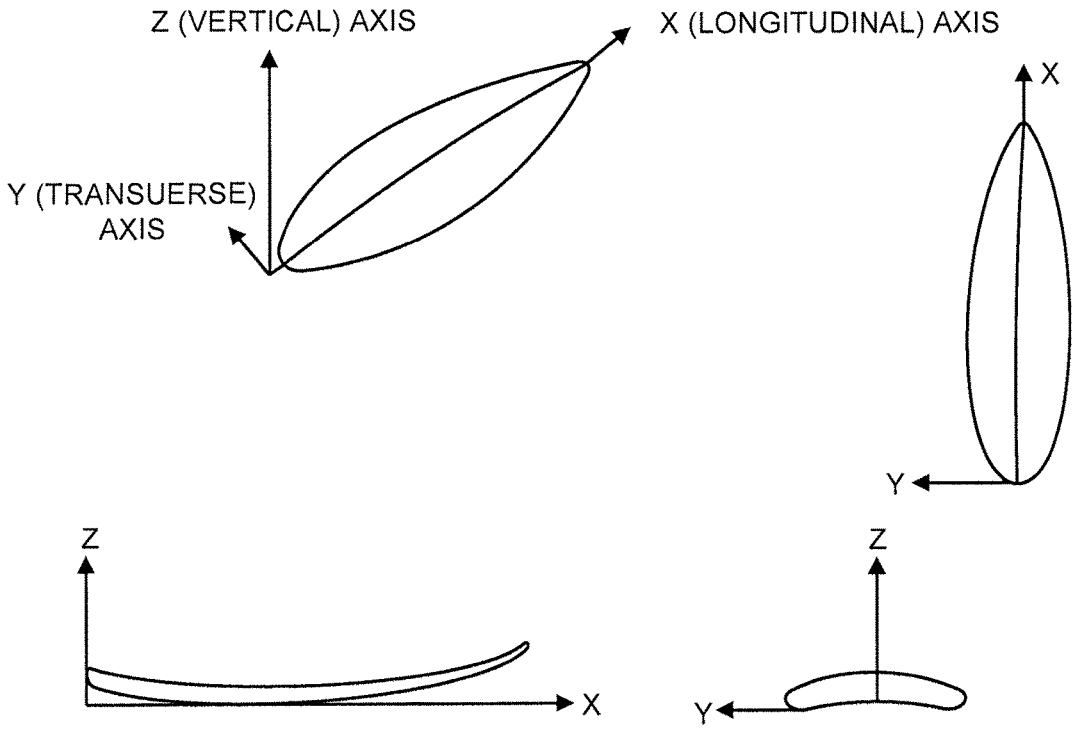
FIG. 30 provides a reference coordinate system associated with the present disclosure.
Figure 31:
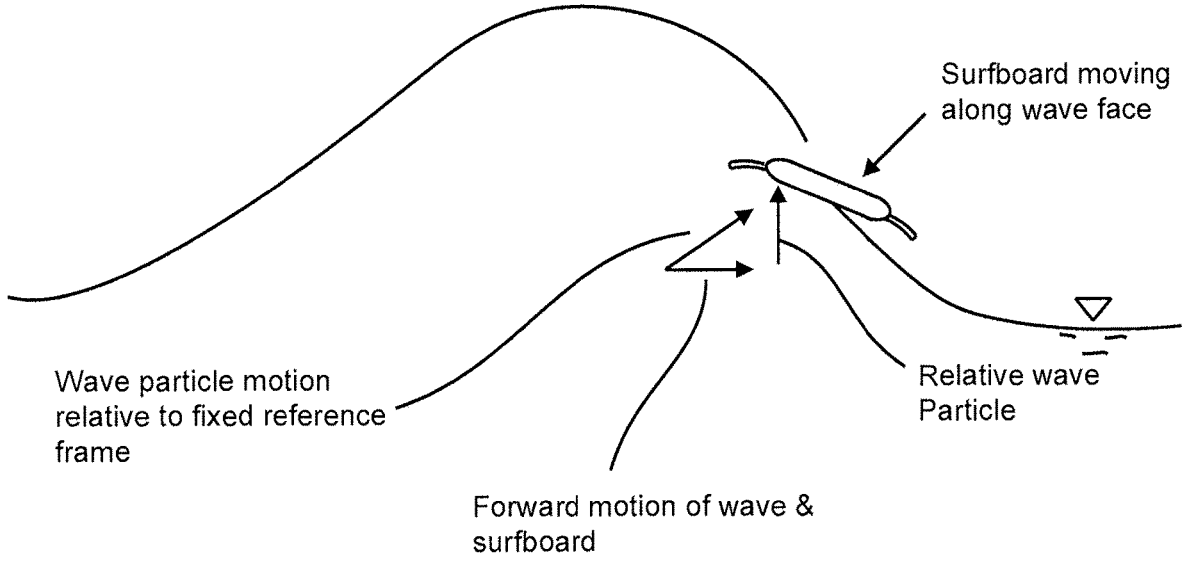
FIG. 31 illustrates relative wave particle motion, as background to the disclosed system herein.

FIG. 26 illustrate a prototypical implementation of a laterally extending hydrofoil, in which the hydrofoil extends at a slight angle downward from horizontal (0 to 45 degrees). FIG. 26 also shows one possible setup of lateral hydrofoil system, using four lateral hydrofoils—two near the center of the surfboard and two near the tail of the surfboard, all of which extend from or proximate the rail of the surfboard. FIG. 27 shows a foil plate 196 and bottom receiver 194 that can be built in to the bottom of the surfboard, for receiving and attaching a hydrofoil 102. The connection mechanism shown in FIG. 27 can also include a locking mechanism 198, such as a screw or the like.

Hydrofoil receivers/boxes of a connection mechanism can be integrated to or with a surfboard foam blank before the blank is shaped, and can take rail alignment form through the shaping process. Alternatively, the receivers/boxes can be pre-installed in material that will form the rail of a surfboard, such as a balsa wood rail or carbon fiber rail.

Reorienting one or more of a surfboard's control surfaces to be generally lateral will: optimize lift provided by wave particle motion acting on generally laterally oriented hydrofoil surfaces in a substantially perpendicular fashion. This allows surfboard to travel a higher line along the wave face resulting in an increase in velocity and potential for maneuvers. Increase in potential energy position. This also increases an ability to accelerate. A lateral hydrofoil system can further decrease overall surfboard drag because rails and tail can be more because board will ride higher in the water resulting in less wetted surface area lowering both friction and form drag. A lateral hydrofoil system can further optimize lift by providing surfaces that utilize foil lift similar to an airplane wing where foil is fully immersed as opposed to a planing hull lift, and enhance surfboard maneuverability due to moving a pivot point (foil extremity) to a location outside surfboard plan view (outline).

Although a few embodiments have been described in detail above, other modifications are possible. Other embodiments may be within the scope of the following claims

The invention claimed is:

1. A surfboard comprising:

a hull defined by a top surface, a bottom surface, a nose, a tail, and opposing side rails extending from the nose to the tail, the opposing side rails defining a transition from the top surface to the bottom surface;

one or more attachment mechanisms mounted into the planar hull at or proximate to at least one of the opposing side rails of the planar hull, each of the one or more attachment mechanisms comprising an attachment site oriented substantially laterally from the planar hull, the attachment site comprising a receptacle; and a hydrofoil configured to removably attach into the receptacle of the attachment site of one of the one or more attachment mechanisms, the hydrofoil further being configured to extend substantially laterally from the planar hull at or proximate to the at least one of the opposing side rails of the planar hull, and extend downward below a plane of the bottom surface of the hull.

2. The surfboard in accordance with claim 1, wherein the one or more attachment mechanisms are mounted in the hull.

3. The surfboard in accordance with claim 1, further comprising a locking mechanism to lock each hydrofoil to the corresponding one of the one or more attachment mechanisms.

4. The surfboard in accordance with claim 1, wherein the hull is comprised of a foam core and a fiberglass outer coating, and wherein each hydrofoil is attached within the fiberglass outer coating.

5. A hydrofoil system for a surfboard, the surfboard having a planar hull defined by a top surface, a bottom surface, a nose, a tail, and opposing side rails extending from the nose to the tail and that define a transition from the top surface to the bottom surface, the hydrofoil system comprising:

one or more attachment mechanisms mounted into the planar hull at or proximate to at least one of the opposing side rails of the planar hull, each of the one or more attachment mechanisms comprising an attachment site oriented substantially laterally from the planar hull; and a hydrofoil configured to removably attach to the attachment site of at least one of the one or more attachment mechanisms, the hydrofoil further being configured to extend substantially laterally from the planar hull at the attachment site, and extend downward below a plane of the bottom surface of the hull.

6. The hydrofoil system in accordance with claim 5, wherein the one or more attachment mechanisms are mounted in the hull.

7. The hydrofoil system in accordance with claim 5, further comprising a locking mechanism to lock each hydrofoil to the corresponding one of the one or more attachment mechanisms.

8. The hydrofoil system in accordance with claim 5, wherein each hydrofoil is attached permanently to the planar hull.

9. An attachment mechanism for a surfboard for receiving a removable, laterally-extending hydrofoil, the surfboard having a planar hull defined by a top surface, a bottom surface, a nose, a tail, and opposing side rails extending from the nose to the tail and that define a transition from the top surface to the bottom surface, the attachment mechanism comprising:

one or more attachment sites positioned into the planar hull at or proximate to at least one of the opposing side rails of the planar hull and toward the tail of the surfboard, each of the one or more attachment sites comprising a receptacle into the planar hull and oriented substantially laterally from the planar hull for receiving and positioning the laterally-extending hydrofoil in a position at or proximate the at least one of the opposing side rails; and a locking mechanism for locking the laterally-extending hydrofoil in the position.

10. The attachment mechanism in accordance with claim 9, wherein the locking mechanism includes one of a screw, a bolt, a latch, a ball, and/or a spring.

* * * * *